US007172533B2

(12) United States Patent
Hobbs

(10) Patent No.: US 7,172,533 B2
(45) Date of Patent: Feb. 6, 2007

(54) HAND-HELD DRINKING CONTAINER

(76) Inventor: John R. Hobbs, 730 Inlet Dr., Marco Island, FL (US) 34145

( * ) Notice: Subject to any disclaimer, the term of this patent is extended or adjusted under 35 U.S.C. 154(b) by 692 days.

(21) Appl. No.: 10/664,321

(22) Filed: Sep. 17, 2003

(65) Prior Publication Data

US 2005/0059533 A1 Mar. 17, 2005

(51) Int. Cl.
*A63B 21/065* (2006.01)

(52) U.S. Cl. ..... 482/74; 482/93; 482/94

(58) Field of Classification Search ..... 482/74, 482/94, 104–108; 473/550; 206/217; 224/148.1, 224/217, 218; 220/914; 222/145.1, 142.6
See application file for complete search history.

(56) References Cited

U.S. PATENT DOCUMENTS 4,702,473 A * 10/1987 Paquette ..... 482/74
4,703,927 A * 11/1987 Hanzlik ..... 482/74
4,712,794 A * 12/1987 Hall ..... 482/74
5,152,431 A * 10/1992 Gardner et al. ..... 222/136
6,152,862 A * 11/2000 Hobbs ..... 482/74
6,217,294 B1 * 4/2001 Arnieri et al. ..... 417/239
6,427,880 B1 * 8/2002 Hirose et al. ..... 222/517

* cited by examiner

*Primary Examiner*—Jerome Donnelly
(74) *Attorney, Agent, or Firm*—The Livingston Firm; Edward M. Livingston; Angela M. Miller

(57) ABSTRACT

A hand-held drinking container for consuming liquids, particularly while a user is engaged in physical activity, such as running, walking or in-line skating. One liquid reservoir (1) forms both the main body (27) and the handle (6) of the container. The user turns a trigger (3) on the outside of the handle (6) so as to enable an internal triggering mechanism (10) to lower a sealer (11) to permit liquid to exit the container via the funnel spout (2) on top of the container. Cushion supports (4) located on the main body (27) press against a back side of the user's hand to allow the user to focus his or her attention on the activity rather than on constantly gripping the container. One or more optional weights (7) can be secured to the bottom of the container by using straps (8) to enhance a workout. An optional flashlight (28) may be secured as well to provide safety for those who prefer exercising when dark.

14 Claims, 6 Drawing Sheets

HAND-HELD DRINKING CONTAINER

BACKGROUND OF THE INVENTION

This invention relates to exercise equipment, more specifically, a drinking container to be used when a person is engaged in exercise or athletic activities.

When exercising, it is especially important to keep one's body replenished with fluid to ward-off the risks associated with dehydration, including dizziness, fatigue, and overheating. However, it is not always convenient for an athlete or exerciser to stop his or her game or workout to quench his or her thirst. Thus, there exists a need for a type of hand-held container for liquids to be used in an athletic environment that is easy to carry.

Many current hand-held liquid dispensers are mouth-operated, which can lead to mouth injuries if a person does not stop his or her activity before use. In addition, many hand-held containers require the use of two hands to open the container, which could cause the distracted athlete to lose his or her balance and thus get injured. Therefore, there exists a need for such hand-held containers to be safe to use and easy to operate while performing an athletic activity.

The present invention helps to aid in the hydration of a person participating in an athletic activity by providing an easy-to-carry hand-held drinking container that is finger activated and does not require two hands to open. In addition, the present invention can also be used as an aid in athletic training where removable weights can be attached to the hand-held drinking containers.

U.S. Pat. No. 6,152,862, issued to this inventor on Nov. 28, 2000 (the '862 patent), describes a hand-held drink dispenser with a plurality of reservoirs for providing measured amounts of liquid intake and an optional weight attachment means. The prior art cited in the '862 patent is hereby integrated by reference.

SUMMARY OF THE INVENTION

The primary object of the present invention is to provide a hand-held drinking container with optional weights to be used by a person while engaged in athletic activities, such as running, walking, and in-line skating.

A further object of the present invention is to provide the drinking container can be used for other purposes, such as weight training.

The present invention fulfills the above and other objects by providing a hand-held drinking container which is finger operated by athletes or exercisers drinking from it. An external valve trigger is connected to a valve line. When the user moves the trigger clockwise or counterclockwise, the trigger mechanism is activated. The trigger mechanism then pulls down on the sealer, thereby allowing liquid to flow from the reservoir, through the funnel spout, and out to the user's mouth. When the trigger is turned to its original position, the sealer returns to its starting position to prevent any more fluid from entering the funnel spout.

In addition, separate weights can be attached to the bottom of the invention preferably by using Velcro™-type hook and loop fastening material to enhance the user's workout.

Preferably, the exercising athlete carries one of the hand-held drinking containers in both hands and first drinks from one container and then from the other in order to maintain weight balance.

The above and other objects, features, and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to a description of a preferred embodiment with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

| | |
|---|---|
| 1. | liquid reservoir |
| 2. | funnel spout |
| 3. | trigger |
| 4. | cushiony support |
| 5. | funneled cap |
| 6. | handle |
| 7. | weight |
| 8. | security strap |
| 9. | spout opening |
| 10. | trigger mechanism |
| 11. | sealer |
| 12. | funneled cap opening |
| 13. | stopper |
| 14. | rod |
| 15. | washer |
| 16. | connector |
| 17. | flat end of rod |
| 18. | link |
| 19. | flap |
| 20. | arm |
| 21. | sealer eyes |
| 22. | screw |
| 23. | sealer-locking mechanism |
| 24. | dimple |
| 25. | recess |
| 26. | bump |
| 27. | main body |
| 28. | flashlight |
| 29. | on/off switch |

Figure 1:
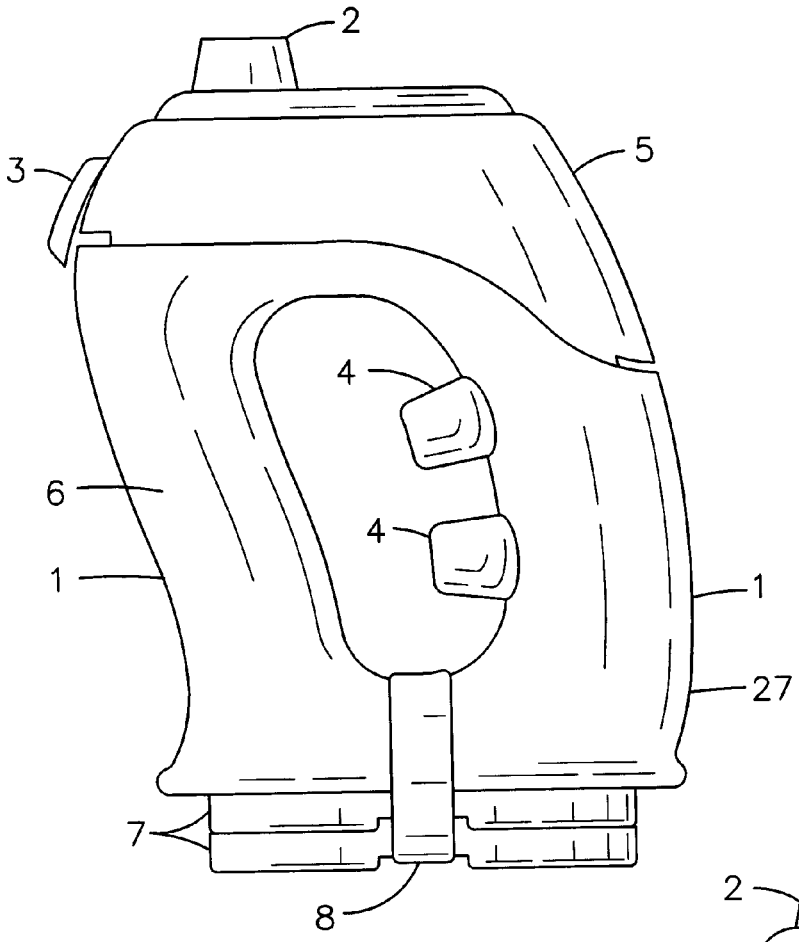
FIG. 1 is a front view of an embodiment of the present invention with optional weights added.

With reference to FIG. 1, a front view of the present invention with optional weights 7 added thereon is shown.

The hand-held drinking container has a funneled cap 5 and a liquid reservoir 1, which is in the shape of a handle 6 and a main body 27. The user places his palm around the handle 6 so as the cushiony supports 4 on the main body 27 are located between his or her index and middle finger and middle finger and ring finger. The cushiony supports 4 are preferably made of foamed rubberlike material to provide light pressure over a broad portion of the user's hand. The cushiony supports 4 promote relaxed holding to allow the user to focus his or attention on the activity being performed instead of on continually gripping the container. Optional weights 7 can be attached to the bottom of the hand-held drinking container by using a security strap 8, preferably made of Velcro™ type hook and loop fastening material.

Figure 2:
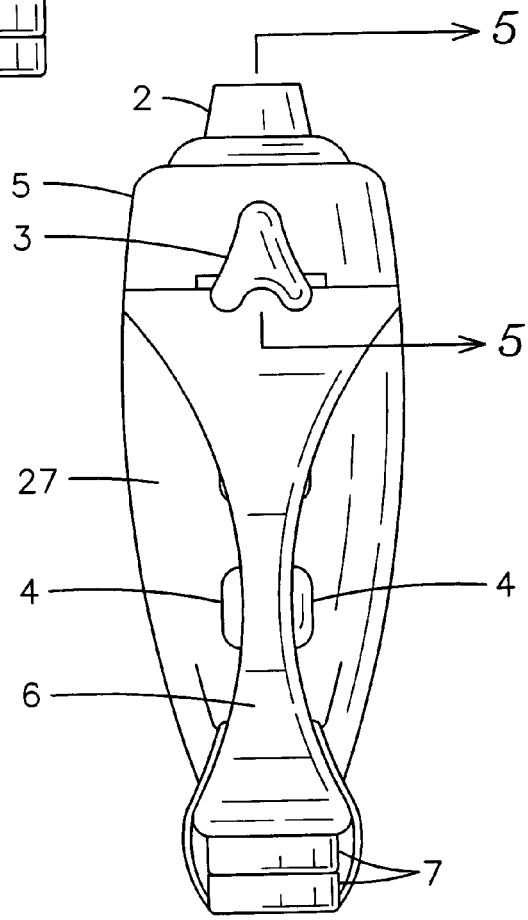
FIG. 2 is a side view of the embodiment of FIG. 1.

In FIG. 2, a side view of the hand-held drinking container is shown with the optional weights 7 added thereon. The handle 6 preferably has a slenderized and curved shape so as to allow easy and comfortable gripping of the container.

Figure 3:
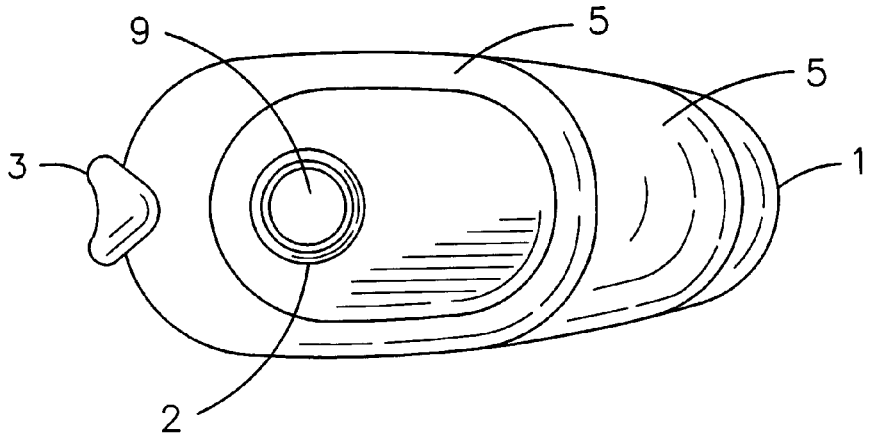
FIG. 3 is a top view of the embodiment of FIG. 1.

In FIG. 3, a top view of the hand-held drinking container is shown. A spout opening 9 allows the fluid to be poured out through the funnel spout 2 which is preferably sized and shaped to fit into the mouths of users.

Figure 4:
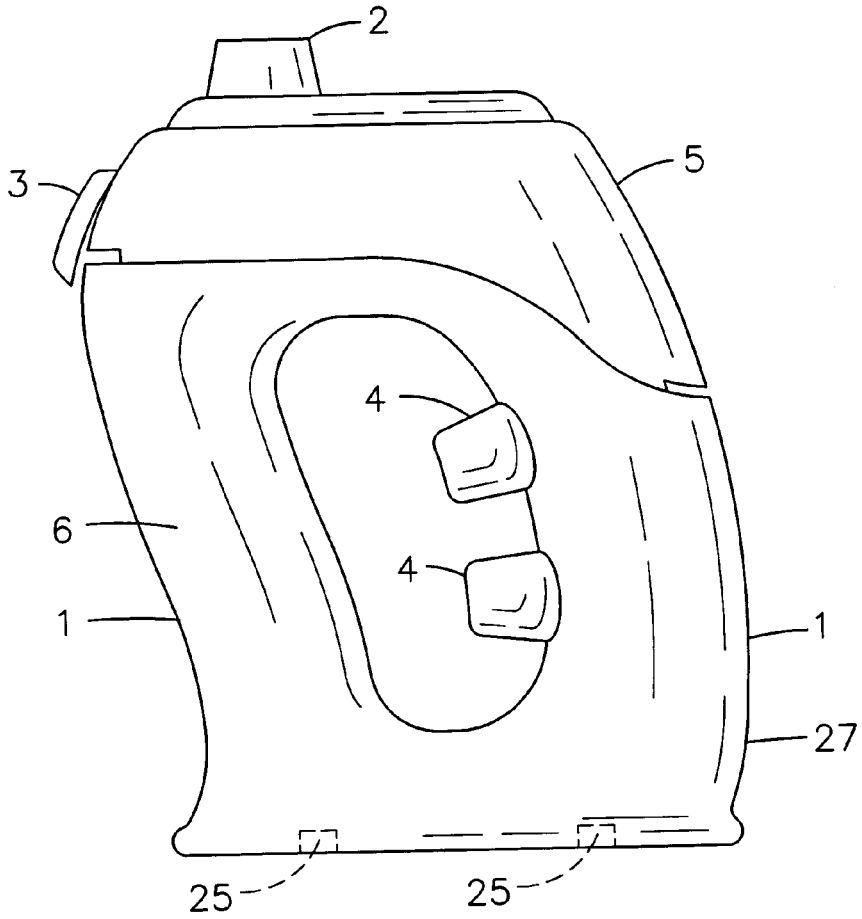
FIG. 4 is a side view of the embodiment of FIG. 1 without the optional weights.

In FIG. 4, a side view of the present invention is shown without the addition of the optional weights 7. The liquid reservoir 1 is substantially flat on the bottom to allow the hand-held drinking container to stand upright when placed on flat surfaces. Recesses 25 are located on the bottom of the liquid reservoir 1 so as to accommodate optional weights 7.

Figure 5:
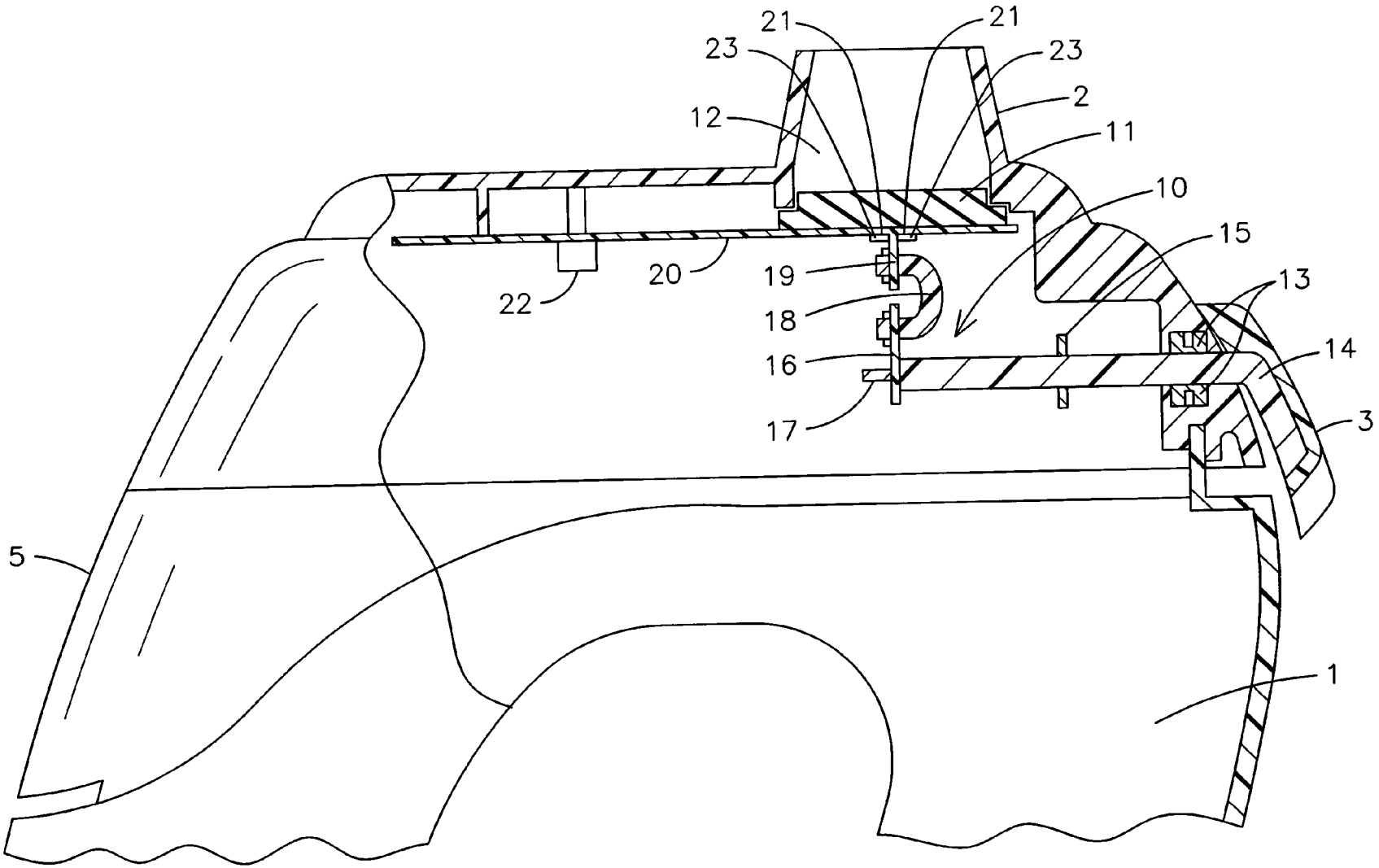
FIG. 5 is a side cross section view along lines 5—5 of the embodiment of FIG. 2.

In FIG. 5, a cut-away view of the funneled cap 5 is shown with the trigger mechanism 10. The trigger 3 is connected to an internal rod 14. Fluid is prevented from leaking through the trigger 3 area by the use of a stopper 13 around the rod 14. The rod 14 has a flat end 17 which is inserted through the bottom hole of the connector 16. The bottom end of a link 18 is then inserted into a top hole of the connector 16 while the top end of the link 18 is inserted into a hole in the flap 19 of the arm 20. A sealer 11, preferably made of rubber, is sized and shaped so as to fit into the funneled cap opening 12 and overlap the funneled cap opening 12 perimeter. The sealer 11 is attached to the arm 20 by inserting the sealer eyes 21 into the sealer-locking mechanism 23 on the arm 20. The arm 20 is secured to the funneled cap 5 by using screws 22. When the user desires a drink, he or she uses his or her thumb to turn the trigger 3 in a clockwise or counterclockwise direction depending on which hand the container is being carried. When the trigger 3 is turned, the rod 14 connected to the trigger 3 turns, causing the flat end of the rod 17 to also turn, which causes the connector 16 to move downward. The link 18 then moves downward and pulls on the flap 19. The sealer 11, in turn, is pulled downward, allowing a gap to form between the sealer 11 and the funneled cap opening 12. This gap allows liquid from the liquid reservoir 1 to enter the funnel spout 2. The user then tilts his or head backwardly and upends the hand-held drinking container to position the funnel spout 2 over the user's mouth to take a drink. Once satisfied, the user positions the container back to its original upright position and uses his or her thumb to turn the trigger 3 back into its original position to prevent more fluid from entering the funnel spout 2.

Figure 6:
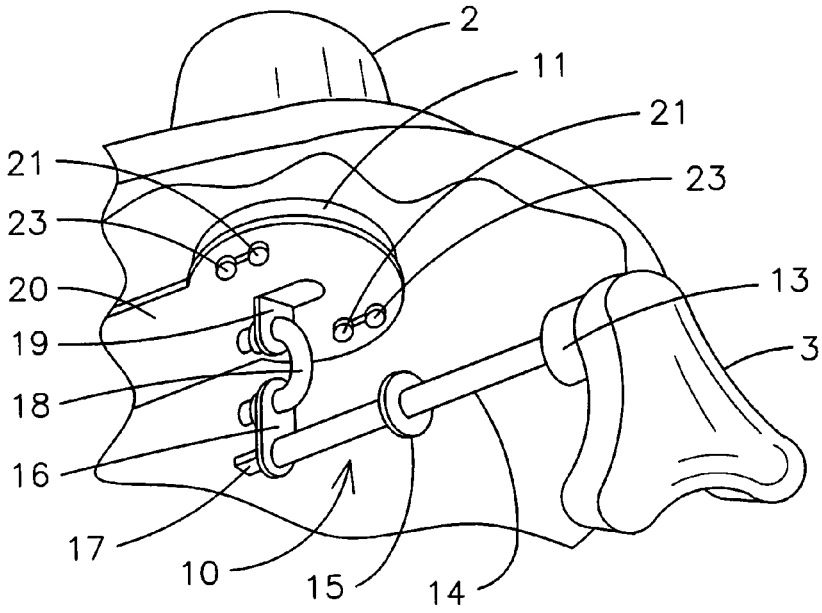
FIG. 6 is a perspective view of the trigger mechanism of the embodiment of FIG. 5.

In FIG. 6, an upward rear perspective view of the trigger mechanism 10 is illustrated showing the same component discussed in relation to FIG. 5.

Figure 7:
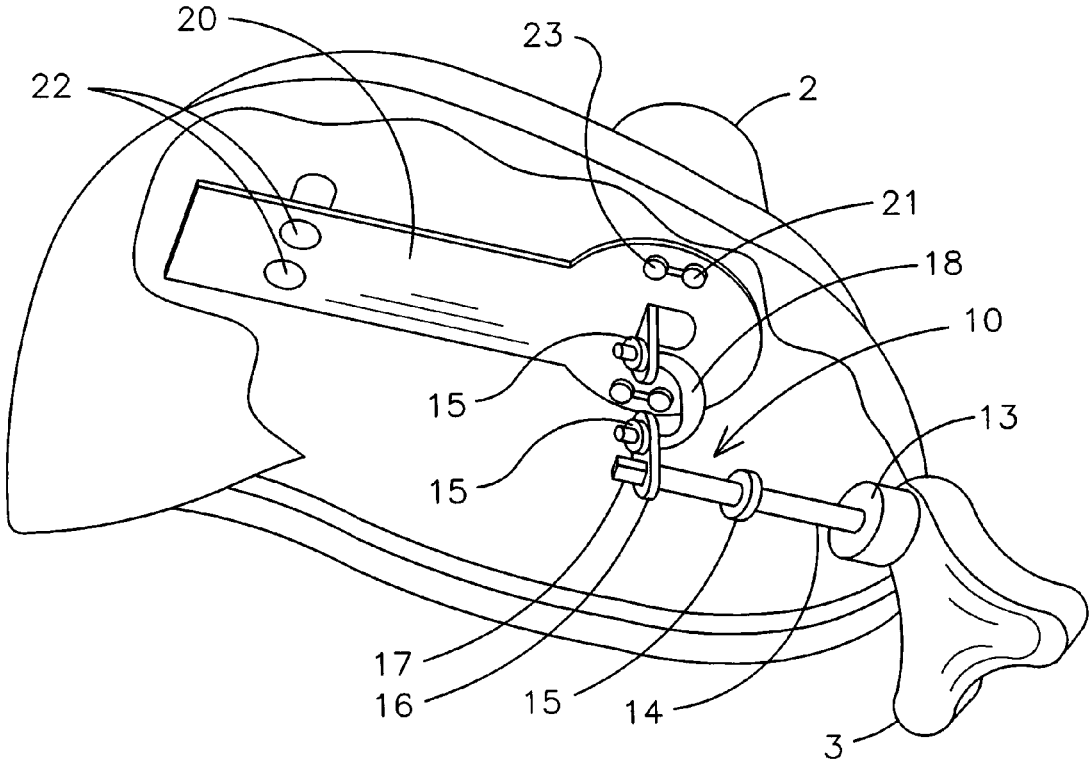
FIG. 7 is a perspective view of the trigger mechanism of the embodiment of FIG. 5.

In FIG. 7, an upward front perspective view of the trigger mechanism 10 is shown in detail. Washers 15 are placed around the ends of the link 18 so as to secure the link 18 both into the flap 19 of the arm 20 and the flat end of the rod 17.

Figure 8:
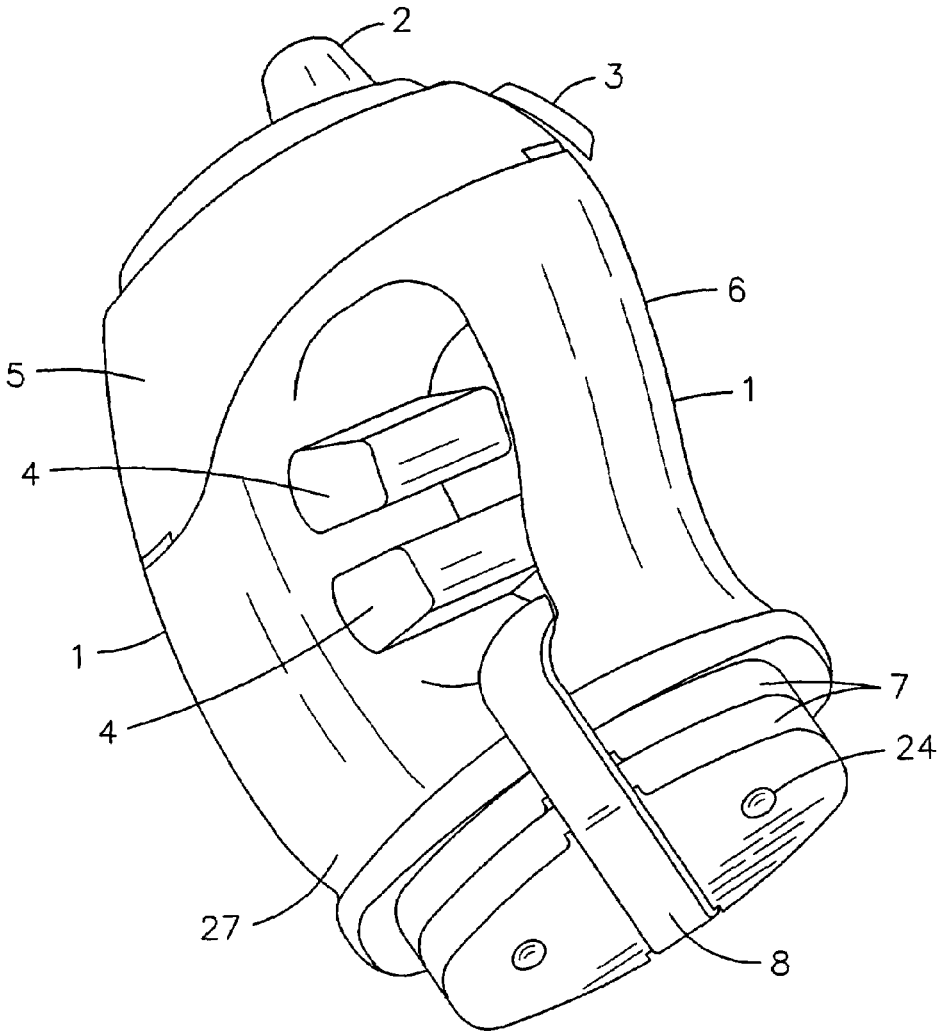
FIG. 8 is a perspective bottom view of the invention showing the optional weights of the embodiment of FIG. 1.

In FIG. 8, an upward perspective view of the bottom of the hand-held drinking container is shown with the optional weights 7 added thereon. The weights 7 are securely fastened to the container by using a security strap 8. Dimples 24 are located on the bottom of each weight 7 to help prevent lateral shifting of the weights 7 during use of the container.

Figure 9:
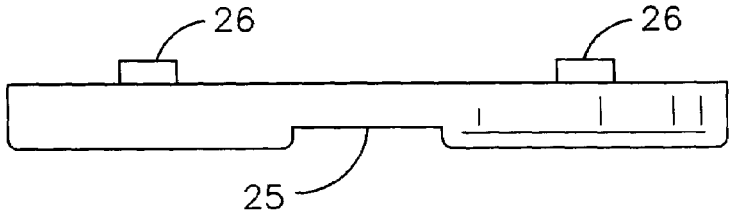
FIG. 9 is a side view of a single weight.

In FIG. 9, a side view of a single weight 7 is shown. The weight 7 has a recess 25 located in the center of the weight and has bumps 26 located on the top surface of the weight on either side of the recess 25. When the weights 7 are stacked, the bumps 26 on the top of the weight 7 fits into the dimples 24 on the bottom of a second weight so as to provide stability in the stacked weights 7. The security strap 8 fits around the recess 25 area of the weight to secure the weights 7 to the container and to keep the weights 7 from sliding while the user is engaged in an athletic activity.

Figure 10:
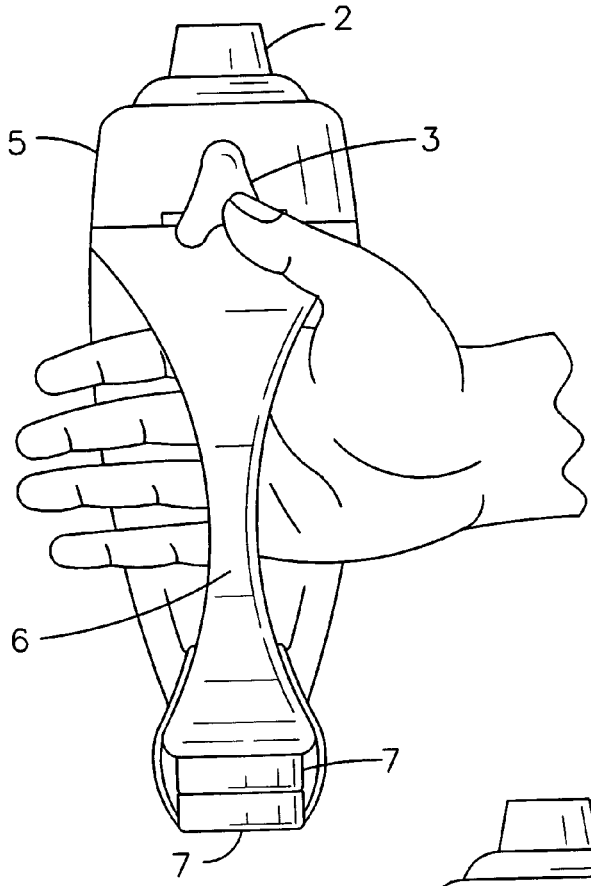
FIG. 10 is a perspective view of the embodiment of FIG. 1 being grasped by a user's hand.

In FIG. 10, a perspective view of a person holding the present invention is shown. A person places his or her palm around the handle 6 and then bends his or her fingers so as to grasp the handle 6. The fingers are placed so as the back of the hand of a person rests against the cushiony supports 4. When the person desires to take a drink, he or she places his or her thumb on the trigger 3 and moves the trigger 3 in a clockwise or counterclockwise direction, depending on which hand the container is being carried.

Figure 11:
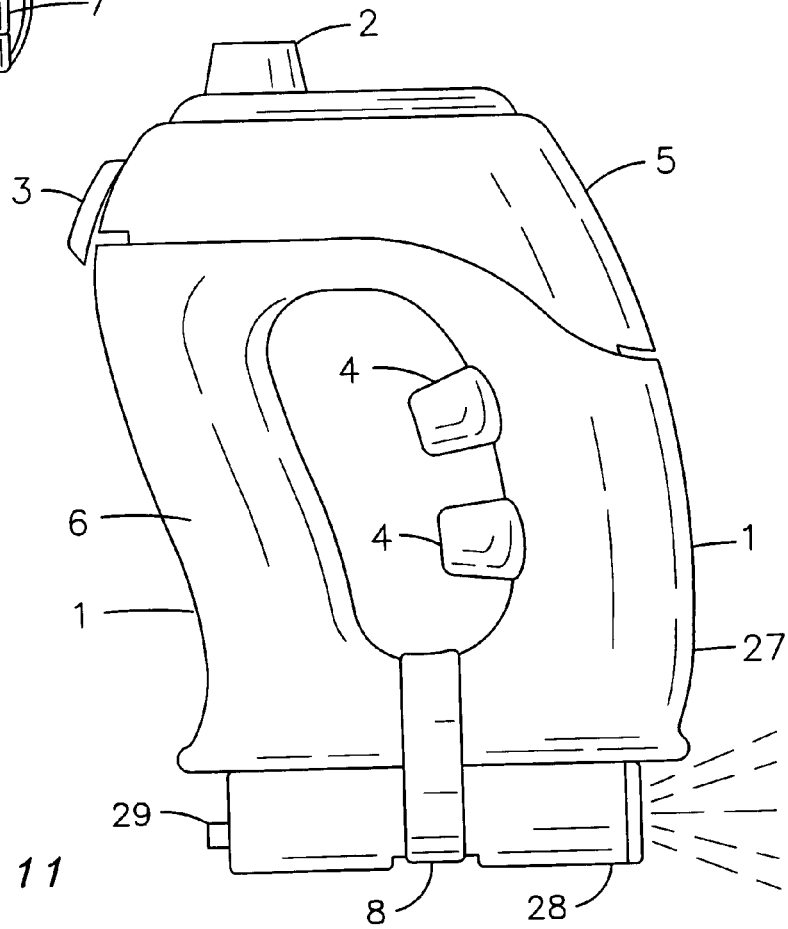
FIG. 11 is a side view of the embodiment of FIG. 4 showing the optional flashlight attachment.

In FIG. 11, a side view of the present invention is shown with an optional flashlight 28 attached via the security strap 8. The optional flashlight 28 has an on/off switch 29 to project light wherever the user prefers.

The hand-held drinking container should be of sufficient shape and size as to accommodate various types of thirst. For example, the container could accommodate 16, 24, or 32 ounces of fluid or more.

As described, the present invention allows users to easily carry a beverage while performing various physical activities. In addition, the optional weight feature allows the user to have a more strenuous workout, if so desired while the optional flashlight attachment promotes safety while performing activities at night.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A hand-held drinking container comprising:

a liquid reservoir having an opening at the upper end and shaped so as to define a handle and a main body;

said handle being spaced from the main body so as to allow a person's hand to fit in between said handle and said main body;

external cushion supports located on said main body; said cushion supports are positioned intermediate the main body and the handle; and said cushion supports are adapted to apply a light pressure against a back of a hand inserted between the main body and the handle, an external trigger connected to an internal triggering mechanism; and said internal triggering mechanism connected to a sealing means located in the container.

2. The hand-held drinking container of claim 1 wherein:

said liquid reservoir has a funneled cap with a funnel spout that is sized and shaped to fit into the user's mouth.

3. The hand-held drinking container of claim 1 wherein:

said external trigger is operable by a digit of a hand grasping said handle.

4. The hand-held drinking container of claim 1 wherein:

said internal triggering mechanism activates said sealing means when said external trigger is turned.

5. The hand-held drinking container of claim 2 wherein:

said sealing means is a sealer sized and shaped so as to fit into an internal entrance to a funnel spout;

said sealer is sized and shaped so as to also overlap the perimeter of the internal entrance to said funnel spout; and said sealer has two eyes jutting from the bottom of the sealer.

6. The hand-held drinking container of claim 1 wherein:

said internal triggering mechanism connected to said sealing means has a rod, a connector, a link, a flap, and an arm;

said rod is connected to said connector by inserting said rod into a hole on said connector;

said connector is connected to said link by inserting one end of the link into another hole on said connector;

said link is connected to said arm by inserting the other end of the link into a hole located on a flap of said arm;

said arm is connected to said liquid reservoir by screws; and said arm has two barbell-shaped cut-outs.

7. The hand-held drinking container of claim 6 wherein:

said barbell-shaped cut-outs accommodate the two sealer eyes on said sealing means;

said sealing means locks onto said arm by inserting the sealer eyes into said barbell-shaped cut-outs and turning; and said sealer is moved away from the internal entrance to said funnel spout when said trigger mechanism is activated.

8. The hand-held drinking container of claim 1 and further comprising an optional weight attachment to the bottom of said main body.

9. The hand-held drinking container of claim 8 wherein:

said optional weight attachment has a means for attachment to the bottom of said main body;

said optional weight attachment is substantially planar;

said optional weight attachment has a top and bottom;

said optional weight attachment length is slightly less than the base length of said container;

said optional weight attachment width is slightly less than the base width of said container;

said optional weight attachment has bumps located on said top;

said optional weight attachment has dimples located on said bottom; and said optional weight attachment has a recess area on said bottom.

10. The hand-held drinking container of claim 9 wherein:

said means for attachment is a hook and loop type fastening material where said material is wrapped around said recess area of said optional weight attachment and said main body of the container.

11. The hand-held drinking container in claim 9 wherein:

said optional weight attachment is variable in weight.

12. The hand-held drinking container of claim 1 and further comprising an optional flashlight attachment to the bottom of said main body.

13. The hand-held drinking container of claim 12 wherein:

said optional flashlight attachment has a means for attachment to the bottom of said main body;

said optional flashlight attachment is substantially planar;

said optional flashlight attachment has a top and bottom;

said optional flashlight attachment length is slightly less than the base length of said container;

said optional flashlight attachment width is slightly less than the base width of said container;

said optional flashlight attachment has bumps located on said top;

said optional flashlight attachment has an on/off switch;

said optional light attachment on/off switch is electrically connected to an internal battery;

said internal battery is replaceable; and said optional flashlight attachment has a recess area on said bottom.

14. The hand-held drinking container of claim 12 wherein:

said means for attachment is a hook and loop type fastening material where said material is wrapped around said recess area of said optional flashlight attachment and said main body of the container.

* * * * *